US009672843B2

(12) United States Patent
Krishnaswamy et al.

(10) Patent No.: US 9,672,843 B2
(45) Date of Patent: Jun. 6, 2017

(54) APPARATUS AND METHOD FOR IMPROVING AN AUDIO SIGNAL IN THE SPECTRAL DOMAIN

(71) Applicant: Apple Inc., Cupertino, CA (US)

(72) Inventors: Arvindh Krishnaswamy, San Jose, CA (US); Joseph M. Williams, Morgan Hill, CA (US)

(73) Assignee: Apple Inc., Cupertino, CA (US)

( * ) Notice: Subject to any disclaimer, the term of this patent is extended or adjusted under 35 U.S.C. 154(b) by 29 days.

(21) Appl. No.: 14/502,863

(22) Filed: Sep. 30, 2014

(65) Prior Publication Data

US 2015/0348562 A1 Dec. 3, 2015

Related U.S. Application Data

(60) Provisional application No. 62/004,748, filed on May 29, 2014.

(51) Int. Cl.

| | |
|---|---|
| ***G10L 21/0264*** | (2013.01) |
| ***G10L 25/18*** | (2013.01) |
| ***G10L 19/02*** | (2013.01) |

(52) U.S. Cl.

CPC ..... *G10L 21/0264* (2013.01); *G10L 25/18* (2013.01)

(58) Field of Classification Search

CPC ..... G10L 19/02

See application file for complete search history.

(56) References Cited

U.S. PATENT DOCUMENTS 5,481,615 A * 1/1996 Eatwell ..... G10K 11/1784 381/103
6,570,991 B1 * 5/2003 Scheirer ..... G10H 1/00 381/110

(Continued)

FOREIGN PATENT DOCUMENTS

EP 2372707 A1 5/2011
WO 2013/167884 A1 11/2013

OTHER PUBLICATIONS

MPEG Unified Speech and Audio Coding Enabling Efficient Coding of both Speech and Music.*

*Primary Examiner* — Ibrahim Siddo
(74) *Attorney, Agent, or Firm* — Blakely, Sokoloff, Taylor & Zafman LLP

(57) ABSTRACT

Method of improving audio signal in the spectral domain starts by receiving audio signal that includes signals from sources including speech source and music source. Audio signal is tuned for output by sound output device. Portions of audio signal are analyzed in a spectral domain to determine whether adjustments are required. Analyzing portions of audio signal includes determining whether anomaly is present in frequency band of audio signal in spectral domain by using at least one metric. Metrics include band energy ratios, spectral centroid, spectral tilt, spectral flux, spectral variance, absolute thresholds, and relative thresholds. Audio signal is adjusted to improve audio signal in spectral domain when audio signal is determined to require adjustments. Adjusting audio signal includes adjusting values of the metric in frequency band that is determined to include anomaly to correspond to clustering of metric values for audio signal in spectral domain. Other embodiments are also described.

18 Claims, 6 Drawing Sheets

(56) References Cited

U.S. PATENT DOCUMENTS

| | | | | |
|---|---|---|---|---|
| 7,488,886 | B2 * | 2/2009 | Kemp | G06F 17/30743 84/609 |
| 7,558,729 | B1 * | 7/2009 | Benyassine | G10L 25/48 370/286 |
| 2003/0012388 | A1 * | 1/2003 | Ura | H04R 3/02 381/66 |
| 2003/0229490 | A1 * | 12/2003 | Etter | G10L 21/04 704/211 |
| 2004/0260540 | A1 * | 12/2004 | Zhang | G10L 25/00 704/205 |
| 2006/0034471 | A1 * | 2/2006 | Bongiovi | H03G 9/18 381/103 |
| 2011/0075851 | A1 * | 3/2011 | LeBoeuf | H04R 29/00 381/56 |
| 2011/0235815 | A1 * | 9/2011 | Hiselius | H04R 3/04 381/62 |
| 2013/0144614 | A1 | 6/2013 | Myllyia et al. | |
| 2014/0074486 | A1 | 3/2014 | Disch et al. | |

* cited by examiner

APPARATUS AND METHOD FOR IMPROVING AN AUDIO SIGNAL IN THE SPECTRAL DOMAIN

CROSS-REFERENCED APPLICATIONS

This application claims the benefit of the U.S. Provisional Application No. 62/004,748, filed May 29, 2014, the entire contents of which are incorporated herein by reference.

FIELD

An embodiment of the invention relates generally to an apparatus and a method for improving an audio signal that includes signals from a plurality of sources (e.g., speech and music) by detecting anomalies in the audio signal in the spectral domain ("sound spectrum") and adjusting the audio signal in the spectral domain based on the detected anomalies. Specifically, the anomalies may be detected using metrics including: band energy ratios, spectral centroid, spectral tilt, spectral flux and spectral variance.

BACKGROUND

Currently, a number of consumer electronic devices are adapted to receive speech via microphone ports or headsets as well as output audio signals including speech via speaker ports, headsets or through external high-end loud speakers. While the typical example is a portable telecommunications device (mobile telephone), with the advent of Voice over IP (VoIP), desktop computers, laptop computers and tablet computers may also be used to perform voice communications.

Rather than being dedicated solely to audio signals including speech signals, these current electronic devices may also be used to output audio signals that include music. When the audio signals including speech are combined with the audio signals including music to be outputted through the same output device (e.g., a speaker port), the processing that is aimed to improve the quality of the speech content may in fact degrade the quality of the music content when it is played back through the output device and vice versa.

SUMMARY

Generally, the invention relates to an apparatus and method of improving an the sound quality of an audio signal that includes signals from speech and music sources when it is output by a sound output device such as an electronic device's internal speaker, a headset that is coupled to the electronic device, an external high-end loudspeaker, etc. Specifically, the invention involves a spectral corrector that assesses the metrics of the audio signal in the spectral domain to determine whether the sound spectrum of the audio signal needs to be adjusted to correct anomalies and performs the adjustments that are needed based on the analysis of the metrics.

In one embodiment of the invention, a method of improving an audio signal in the spectral domain that starts with a spectral corrector included in an electronic device receiving the audio signal that includes signals from plurality of sources. The sources may include a speech source and a music source. The audio signal may be tuned for output by a sound output device. The spectral corrector then analyses portions of the audio signal in a spectral domain to determine whether the audio signal requires adjustments. Analyzing portions of the audio signal may include determining whether an anomaly is present in a frequency band of the audio signal in the spectral domain by using at least one of a plurality of metrics. The metrics may include band energy ratios, spectral centroid, spectral tilt, spectral flux, spectral variance, absolute thresholds, and relative thresholds. The spectral fixer then adjusts the audio signal to improve the audio signal in the spectral domain when the audio signal is determined to require adjustments. Adjusting the audio signal may include adjusting values of the at least one metric in the frequency band that is determined to include the anomaly to correspond to a clustering of values of the metrics for the audio signal in a spectral domain.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Figure 1:
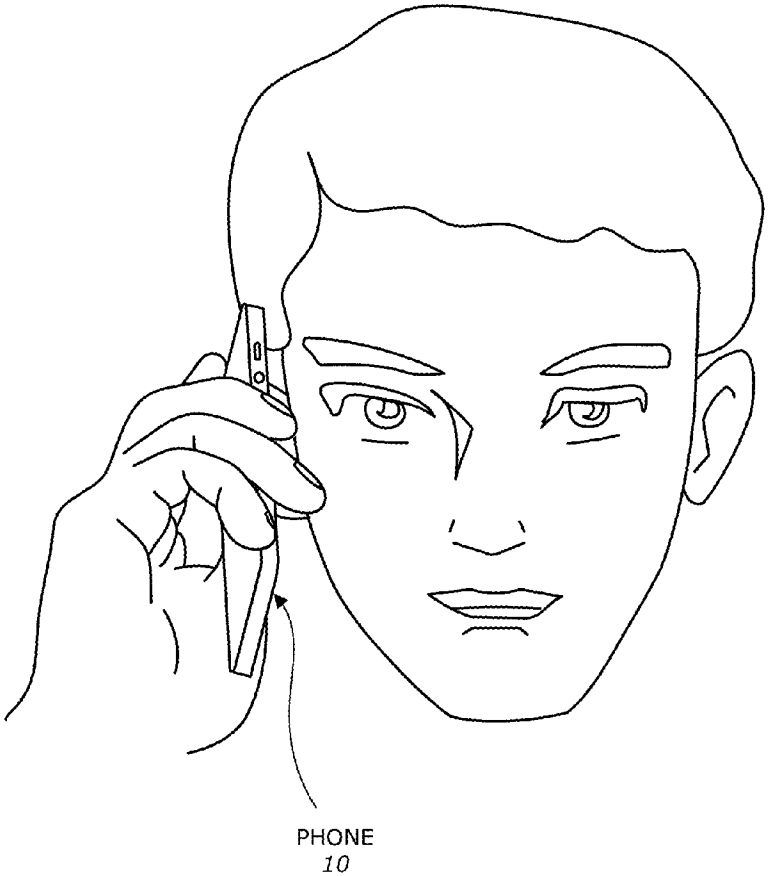
FIG. 1 illustrates an example of a consumer electronic device in which an embodiment of the invention may be implemented.

FIG. 1 illustrates an instance of a consumer electronic device in which an embodiment of the invention may be implemented. As shown in FIG. 1, the electronic device 10 may be a mobile telephone communications device or a smartphone. The electronic device 10 may also be a tablet computer, a personal digital media player or a notebook computer. The electronic device 10 may provide the functionality of media player, a web browser, a cellular phone, a gaming platform, a personal data organizer, and so forth. Accordingly, the electronic device 10 may include microphones to receive the user's speech, audio signals including music, etc. The microphones may be air interface sound pickup devices that convert sound into an electrical signal. The electronic device 10 may also include a speaker unit (e.g., internal speaker) that plays back the audio signals that include speech signals, music signals or a signal that combines speech and music signals. Accordingly, the audio signals may be from a plurality of sources including sources providing speech signals as well as sources providing music signals. In other embodiments, the electronic device 10 may transmit the audio signals to an external speaker (e.g., high-end loudspeakers) to playback the audio signals from the different sources.

Figure 2:
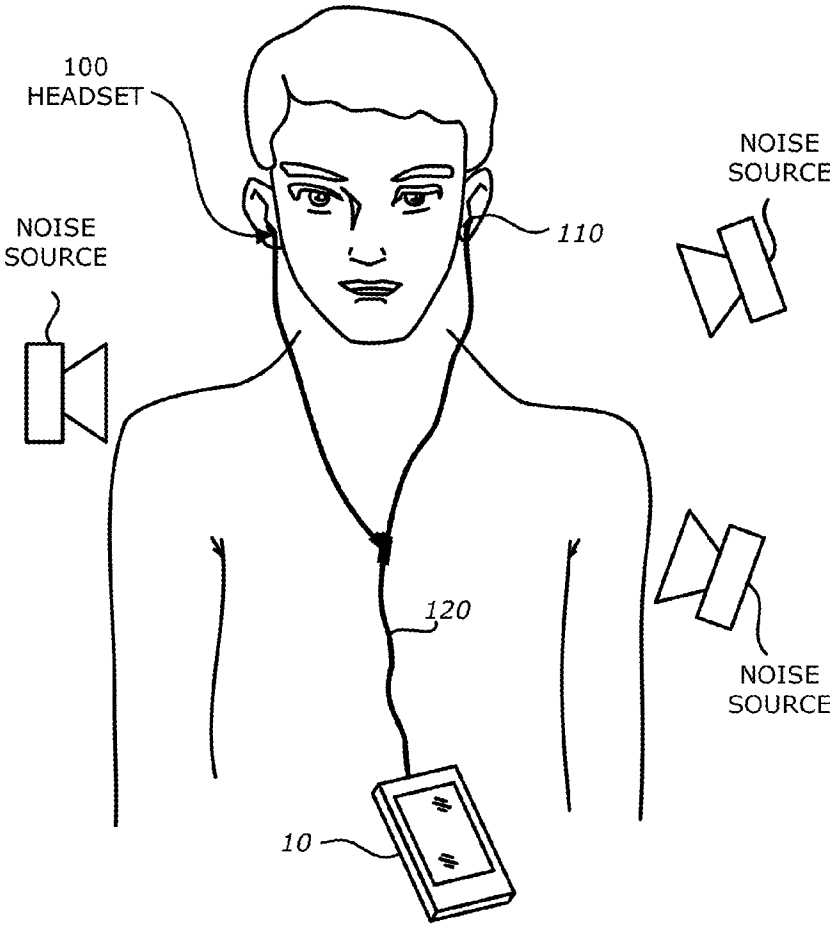
FIG. 2 illustrates an example of the electronic device including a headset in use according to one embodiment of the invention.

FIG. 2 illustrates an example of an electronic device 10 including a headset in use according to one embodiment of the invention. As shown in FIG. 1, the headset 100 may include a pair of earbuds 110 and a headset wire 120. The user may place one or both the earbuds 110 into his ears to hear outputted audio signals that may include speech or music and the microphones in the headset may receive his speech. The microphones in the headset may also receive other audio signals including music or noise. The microphones included in the headset 100 may also be air interface sound pickup devices that convert sound into an electrical signal. The headset 100 in FIG. 1 is double-earpiece headset. It is understood that single-earpiece or monaural headsets may also be used. While the headset 100 in FIG. 2 is an in-ear type of headset that includes a pair of earbuds 110 which are placed inside the user's ears, respectively, it is understood that headsets that include a pair of earcups that are placed over the user's ears may also be used. Additionally, embodiments of the invention may also use other types of headsets.

It is observed that when the microphones are used to capture person's speech or music, the audio signal that is heard when played back may not be identical to the audio that was captured (e.g., how the audio sounds live). For instance, when a user's speech may sound normal live but when it was captured using the microphones and played back via the internal or external speakers or the headset, the played back audio signal may include defects such as the presence of sibilance, which is heard as a high frequency "s" sounds.

A previous solution to eliminate the sibilance that is heard in the speech portion of the audio signal is to de-ess the audio signal. However, by de-essing an audio signal that includes both speech and music, while the speech portion is improved, the music portion of the signal may suffer. Further, de-essing the audio signal without taking into account the sound output device through which the audio signal is to be played back may generate a de-essed audio signal that sounds normal through one sound output device (e.g., headset) but may still include sharp "s" sounds through another sound output device (e.g., internal speaker). This difference in audio playback of the same de-essed content is due to the fact that some de-essing is required to be hardware specific. For instance, the frequency response, the distortion characteristics, and acoustical properties of a given sound output device may be affecting the played back sound in different ways.

Figure 3:
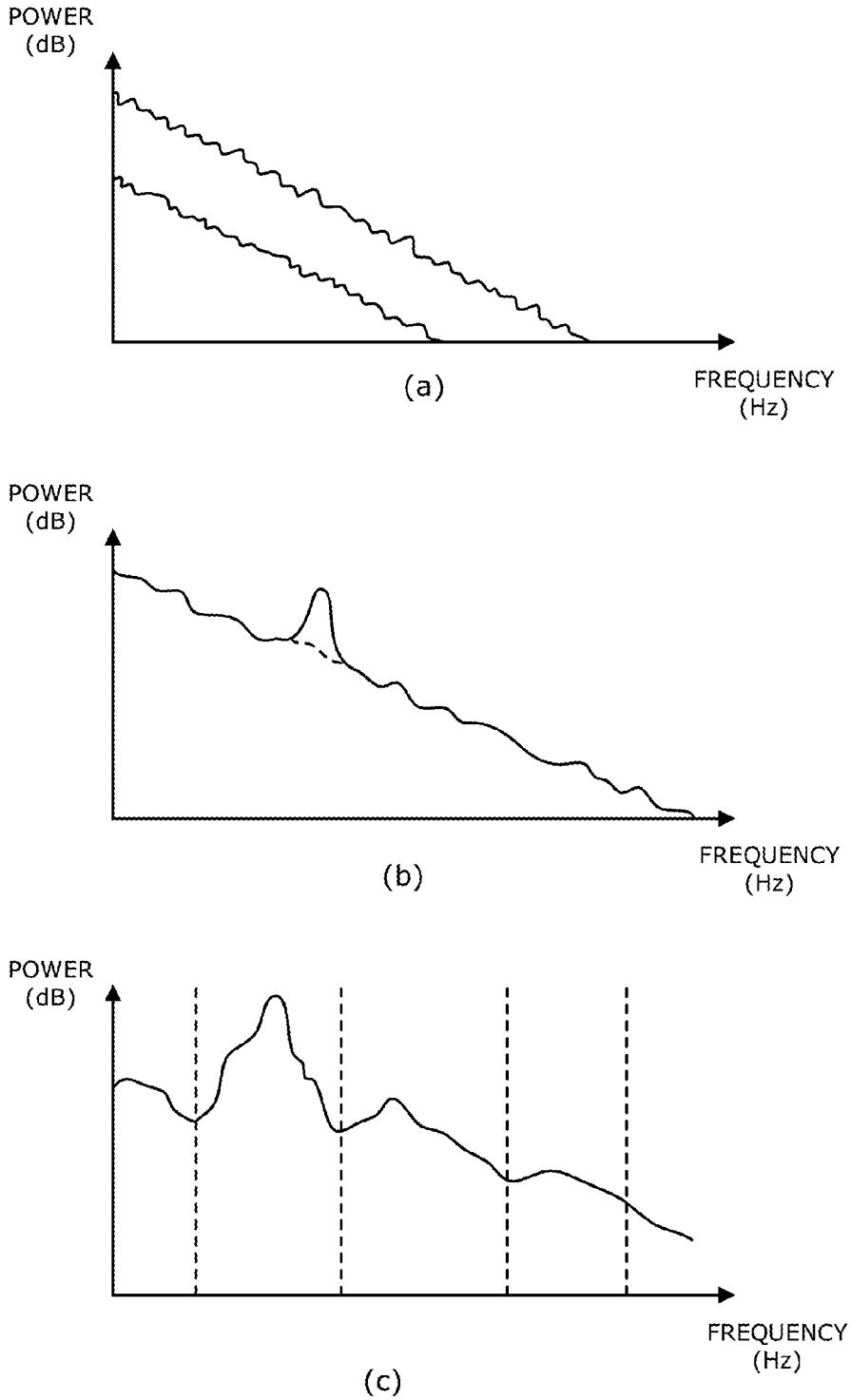
FIG. 3 illustrates examples of (a) normal sound spectrums, (b) a sound spectrum including an anomaly, and (c) an example of a sound spectrum to be improved using an embodiment of the invention.

In order to correct defects such as sibilance that is present in the audio signals, embodiments of the invention assess the audio signals in the spectral domain and correct (e.g., de-essing for sibilance) the audio signals accordingly. FIG. 3 illustrates examples of (a) normal sound spectrums, (b) a sound spectrum including an anomaly, and (c) an example of a sound spectrum to be improved using an embodiment of the invention. As shown in the spectral domain, the graph of (a) normal sound spectrum that does not include anomalies maintains similar energy levels and trends whereas the graph of (b) a sound spectrum having an anomaly includes an emphasis in the energy band where the anomaly is present. In FIG. 3, in the graph (c), an example of a sound spectrum is illustrated. In this example of a sound spectrum, the anomalies may be more difficult to detect because the audio signal may include speech and music. Specifically, it is difficult to determine whether the changes in energy levels are due to the desired change in the music and the speech or if a defect in the audio signal is present.

Figure 4:
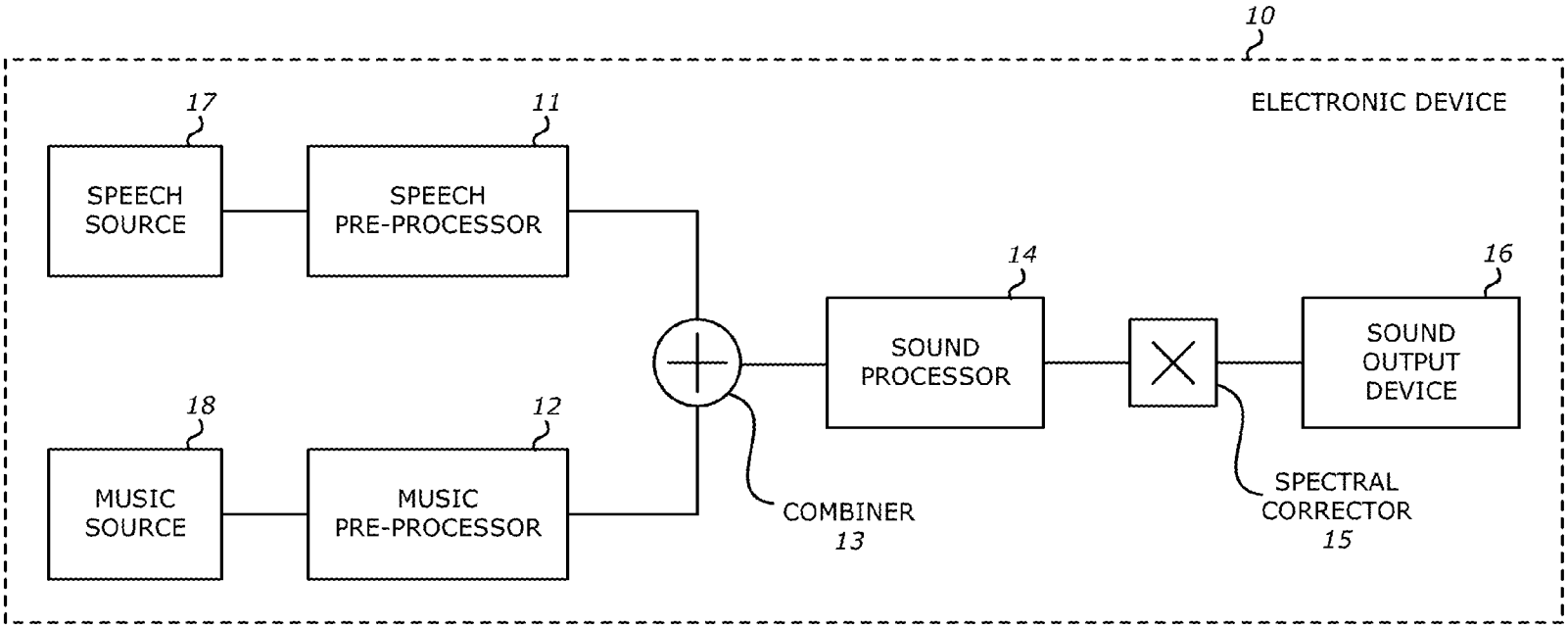
FIG. 4 illustrates a block diagram of an electronic device to improve an audio signal in the spectral domain according to an embodiment of the invention.

FIG. 4 illustrates a block diagram of an electronic device 10 to improve an audio signal in the spectral domain for one sound output device according to an embodiment of the invention. As shown in FIG. 4, the electronic device 10 receives a speech signal and a music signal from a speech source 17 and music source 18, respectively. A speech pre-processor 11 pre-processes the speech signal while a music pre-processor 12 pre-processes the music signal. Pre-processing by the speech and music pre-processors 11, 12 may include, for instance, correcting defects that are specific to the speech and music, respectively. For instance, the speech pre-processor 11 may perform Stochastic Particle Filtering (SPF) and speech content specific de-essing. The music pre-processor 12 may perform Sample Rate Conversion (SRC). The speech pre-processor 11 and the music pre-processor 12 may also perform noise suppression, compression, and content equalization on their respective signals.

The pre-processed speech signal and the pre-processed music signal that are output from the speech and music pre-processors 11, 12, respectively, may then be combined or mixed by the audio signal combiner 13 which outputs a combined audio signal that includes both speech and music signals to the sound output device 16's sound processor 14. The sound processor may be a tuner that is adapted to improve the sound quality of the audio signals for output by the sound output device 16. The sound output device 16 may be for instance the electronic device's internal speaker. While it is illustrated as internal to the electronic device 10, it is contemplated that the sound output device 16 may be high quality loudspeakers that are external to the electronic device 10 or a headset 100 that is used in connection with the electronic device 10.

As discussed above, the frequency response, the distortion characteristics, and acoustical properties of a given sound output device 16 may affect the played back sound in different ways. Accordingly, the sound processor 14 may perform processing on the combined audio signal to improve the sound quality of the combined audio signal to be output by the specific sound output device 16 that is, for example, the electronic device's internal speaker. However, it is possible that the sound processor 14's processing aimed at improving the sound quality of the music portion of the combined audio signal when played back by the electronic device's internal speaker would have the undesired effect of degrading the sound quality of the voice portion of the combined audio signal when played back by the electronic device's internal speaker. For instance, the sound processor 14's processing to enhance the music portion of the combined audio signal may conflict with the de-essing that was performed by the speech pre-processor 11 on the speech signal such that when played back by the electronic device's internal speaker 16, the speech portion of the combined audio signal includes the high frequency "s" sounds regardless of the de-essing that was performed by the speech pre-processor 11.

Accordingly, in some embodiments, as shown in FIG. 4, the electronic device 10 includes a spectral corrector 15 that (i) detects whether there is an anomaly in the sound spectrum of the combined audio signal to be output from the sound output device 16, and (ii) adjusts the sound spectrum to eliminate the anomaly such that the sound output device 16 outputs an acoustic signal that has a normal sound spectrum. In order to perform this detection (or classification) function and the adjustment function, the spectral corrector 15 may utilize one or more metrics including: the band energy ratios, the spectral centroid, the spectral tilt, the spectral flux, the spectral variance, absolute thresholds, relative thresholds, etc. . . . . In some embodiments, the spectral corrector 15 includes a processor 18 that performs (i) the detection of the anomaly and (ii) the adjustments of the sound spectrum to output the acoustic signals.

First, the spectral corrector 15 may receive the processed combined audio signal from the sound processor 14 and assess the sound spectrum of the processed combined audio signal. For example, with respect to the band energy ratios metric, the spectral corrector 15 detects the problematic frequency bands in the sound spectrum of the processed combined audio signal. The spectral corrector 15 may then compute the energy in that band and compare the ratio of the energy in that band and the energy in the whole band of the sound spectrum. If the ratio exceeds a pre-determined value, the spectral corrector 15 may adjust the energy in that band to a level that is reasonable in light of the energy in the whole band of the sound spectrum. The pre-determined value may represent or be a ratio value that is pre-determined to indicate anomalies in the sound spectrum. In some embodiments, the spectral corrector 15 adjusts the energy level in that band to approximately match the trend in the energy level in the whole band of the sound spectrum. For instance, as illustrated in FIG. 3(*b*), the trend of the whole band is matched by adjusting the energy level to be the dotted lines in the graph. The energy level in the whole band of that sound spectrum is steadily decreasing. Accordingly, the spike in energy that is illustrated in FIG. 3(*b*) is detected as an anomaly based on the comparison of the ratio of the energy in that band with the energy in the whole band of the sound spectrum (e.g., the ratio exceeds a predetermined threshold). The spectral corrector 15 thus adjusts the energy level of that band to be a steadily decreasing energy level such that it matches the trend of the whole band of the sound spectrum rather than adjusting the energy level by merely applying a maximum energy level cutoff (e.g., low pass filter).

When assessing normal (or good) sounding speech and normal (or good) sounding music, the plotting of the metrics shows that the metrics will cluster around reasonable values. The anomalies in the spectral domain are found when the values of the metrics depart from reasonable cluster. Accordingly, the adjustment in the spectral domain may entail adjusting the value of the metric back to the reasonable value. In embodiments of the invention, the reasonable values are not static but are dynamic in that they take into account the values of the metrics in the sound spectrum.

For example, the graph (b) in FIG. 3 may illustrate a processed combined audio signal received by the spectral corrector 15. The spectral corrector 15 may detect that a sibilance anomaly is present in one of the bands in the sound spectrum given that the ratio of the energy in that band and the energy in the whole band of the sound spectrum exceeds a pre-determined value. Using the reasonable values of the whole band of the sound spectrum (e.g., reasonable cluster of metric values), the spectral corrector 15 adjusts the value of the band including the anomaly (e.g., where the value of the metric departs from the reasonable cluster) to match the metric values of the remaining bands of the sound spectrum as illustrated as a dotted line in graph (b) in FIG. 3.

As discussed above, the metrics include the band energy ratios, the spectral centroid, the spectral tilt, the spectral flux, the spectral variance, absolute thresholds, relative thresholds, etc. In one embodiment, to perform the detection (or classification) function, the spectral corrector 15 may also use the metrics to determine the type of content, whether the content should be modified and how to modify the content. For instance, using the metrics, the spectral corrector 15 may determine whether the processed combined audio signal includes speech or non-speech.

The spectral corrector 15 may also use a combination of the metrics to determine whether energy of a band in the sound spectrum requires adjustments (e.g., suppression). For instance, if the band-energy ratio metric is greater than a pre-determined value that indicates an anomaly in the sibilant band, the spectral corrector 15 may also assess the centroids metric to determine the centroids metric indicates an anomaly in the sibilant band. In this embodiment, the spectral corrector 15 only adjusts (or suppresses) the energy in the sibilant band if both the band-energy ratio and the centroids indicate an anomaly in the sibilant band.

In another example, spectral corrector 15 uses the flux and tilt metrics to detect the type of content, and classify whether the content should be modified, and determine how to adjust (or suppress) the content accordingly. For instance, when music content in the processed combined audio signal is detected, the spectral corrector 15 may apply a slower release time on the suppression of the processed combined audio signal, and when speech content in the processed combined audio signal is detected, the spectral corrector 15 may apply a faster release time on the suppression of the processed combined audio signal.

Accordingly, the spectral corrector 15 may be used to improve the processed combined audio signal in the spectral domain using at least one metric before it is output by the sound output device 16. The spectral corrector 15 may act as a de-esser but it may also provide similar adjustments to music that includes anomalies in the equalization. The spectral corrector 15 thus generates an improved audio signal to be output by the sound output device 16.

While FIG. 4 illustrates a single spectral corrector 15 coupled to a single sound output device 16, it is contemplated that the combiner 13 may output a combined audio signal that includes both speech and music signals to a plurality of different sound output devices 16's respective sound processors 14. For instance, as discussed above, the sound output devices 16 may include electronic device 10's internal speakers, high quality loudspeakers that are external to the electronic device 10 and a headset 100 that is used in connection with the electronic device 10. Accordingly, the sound processors 14 that are respective to each of these different sound output devices 16 may process the combined audio signal from the combiner 13. In this embodiment, the output from each of the sound output devices 16 would be received by spectral correctors 15, respectively, that further improve the processed combined audio signal in the spectral domain using at least one metric before it is output by the sound output devices 16, respectively.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 5:
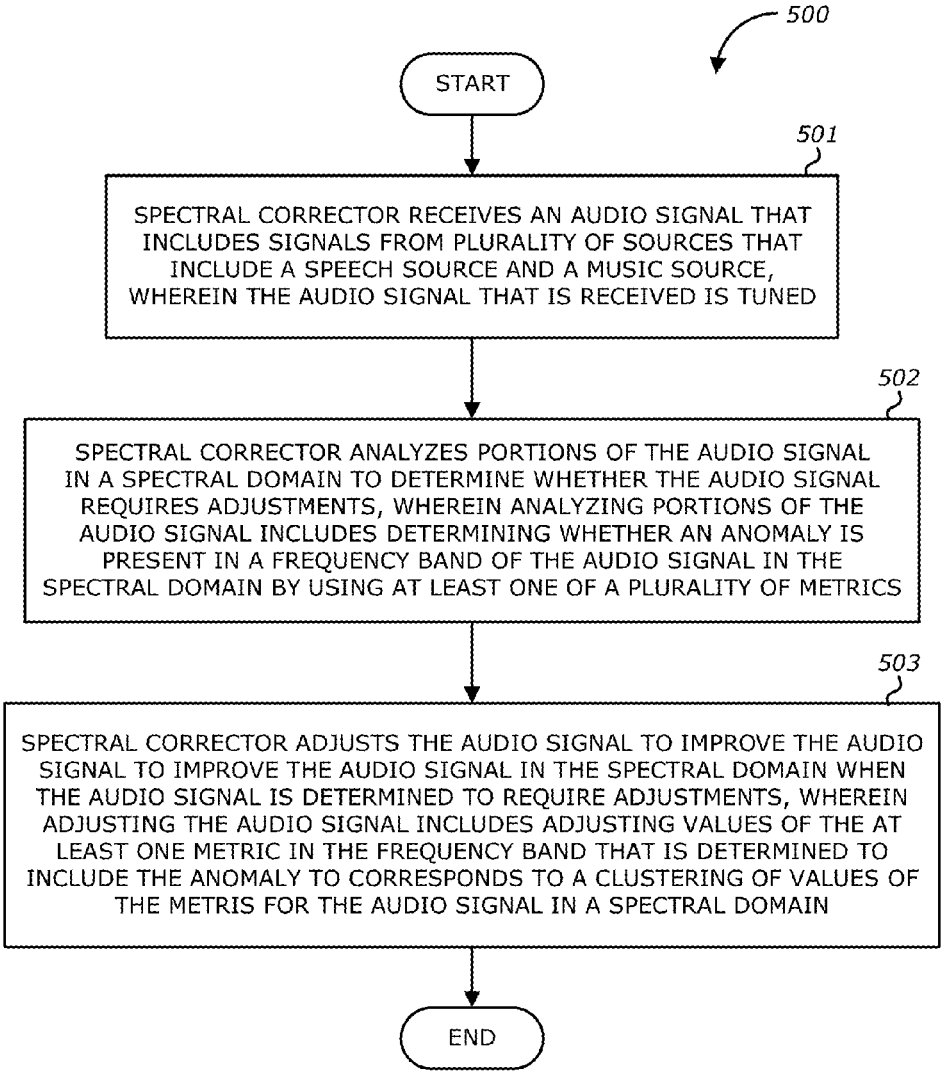
FIG. 5 illustrates a flow diagram of an example method to improve an audio signal in the spectral domain according to an embodiment of the invention.

FIG. 5 illustrates a flow diagram of an example method to improve an audio signal in the spectral domain according to an embodiment of the invention. The method 500 starts at Block 501 with the spectral corrector receiving an audio signal that includes signals from plurality of sources that include a speech source and a music source. The audio signal that is received may also be an audio signal that is tuned for output by a sound output device by a sound processor (or tuner). At Block 502, the spectral corrector analyzes portions of the audio signal in a spectral domain to determine whether the audio signal requires adjustments. In some embodiments, analyzing portions of the audio signal includes determining whether an anomaly is present in a frequency band of the audio signal in the spectral domain by using at least one of a plurality of metrics. The metrics may include band energy ratios, spectral centroid, spectral tilt, spectral flux, spectral variance, absolute thresholds, and relative thresholds. At Block 503, the spectral corrector adjusts the audio signal to improve the audio signal in the spectral domain when the audio signal is determined to require adjustments at Block 502. In some embodiments, adjusting the audio signal includes adjusting values of the at least one metric in the frequency band that is determined to include the anomaly to correspond to a clustering of values of the metrics for the audio signal in a spectral domain.

Figure 6:
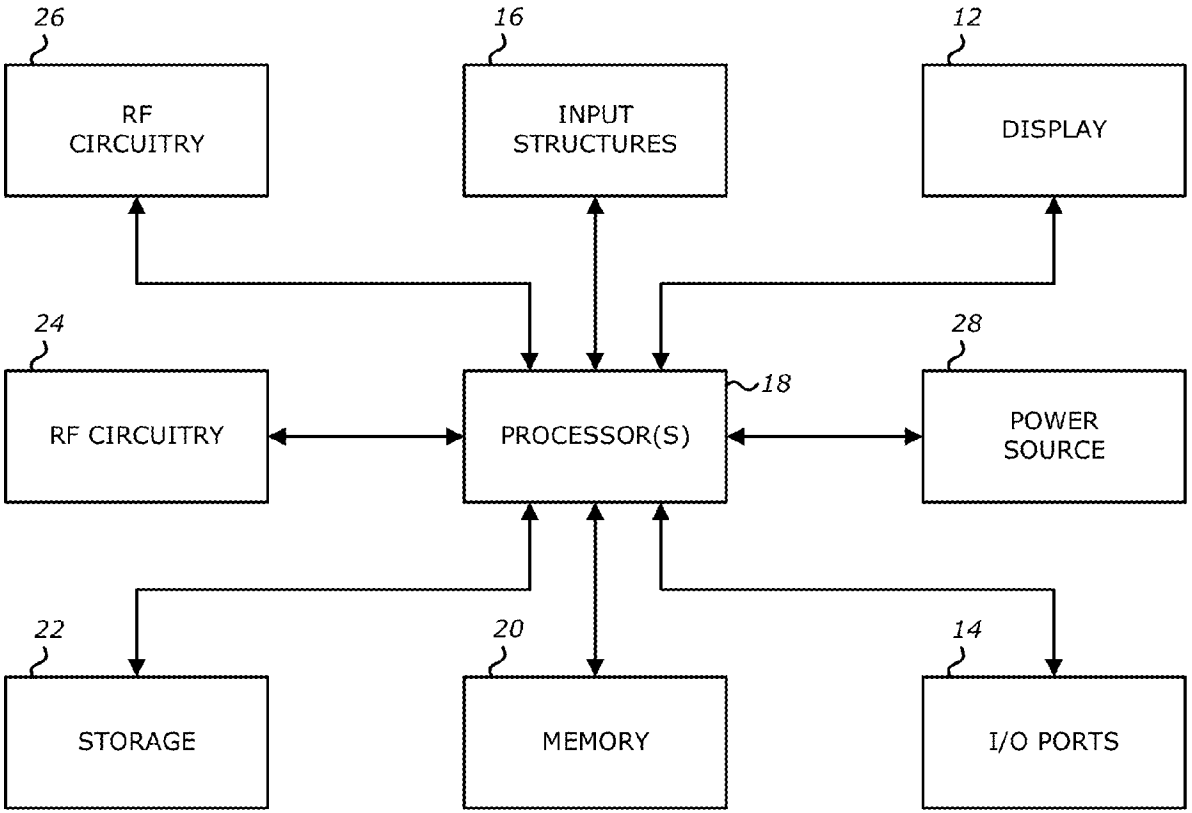
FIG. 6 is a block diagram of exemplary components of an electronic device detecting a user's voice activity in accordance with aspects of the present disclosure.

A general description of suitable electronic devices for performing these functions is provided below with respect to FIG. 6. Specifically, FIG. 6 is a block diagram depicting various components that may be present in electronic devices suitable for use with the present techniques. These types of electronic devices, as well as other electronic devices providing comparable voice communications capabilities (e.g., VoIP, telephone communications, etc.), may be used in conjunction with the present techniques.

Keeping the above points in mind, FIG. 6 is a block diagram illustrating components that may be present in one such electronic device 10, and which may allow the device 10 to function in accordance with the techniques discussed herein. The various functional blocks shown in FIG. 6 may include hardware elements (including circuitry), software elements (including computer code stored on a computer-readable medium, such as a hard drive or system memory), or a combination of both hardware and software elements. It should be noted that FIG. 6 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28. In some embodiments, the processor 18 executes instructions that are stored in the memory devices 20 that cause the processor 18 to perform the method to improve an audio signal in the spectral domain described in FIG. 5.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

What is claimed is:

1. A method of improving an audio signal in the spectral domain comprising:

receiving by a spectral corrector a combined audio signal that includes a pre-processed speech signal and a pre-processed music signal, wherein the combined audio signal is tuned for output by a sound output device;

analyzing by the spectral corrector portions of the combined audio signal in a spectral domain to determine whether the combined audio signal requires adjustment, wherein analyzing portions of the combined audio signal includes:

determining whether an anomaly is present in a frequency band of the combined audio signal in the spectral domain by using at least one metric of a plurality of metrics, detecting a type of content using the at least one metric, wherein the at least one metric includes a spectral tilt and a spectral flux, determining whether to adjust the combined audio signal based on the type of content detected; and adjusting by the spectral corrector the combined audio signal to improve the combined audio signal in the spectral domain when the combined audio signal is determined to require adjustment, wherein adjusting the combined audio signal includes adjusting a value of the at least one metric in the frequency band that is determined to include the anomaly to correspond to a clustering of values of the at least one metric for the combined audio signal in a spectral domain, wherein adjusting the combined audio signal includes applying a first release time on suppression of the combined audio signal when the type of content is a music content, and applying a second release time on suppression of the combined audio signal when the type of content detected is a speech content, wherein the first release time is slower than the second release time.

2. The method of claim 1, wherein the plurality of metrics further include a band energy ratio, spectral centroid, spectral variance, absolute thresholds, and relative thresholds.

3. The method of claim 1, wherein the at least one metric further comprises a band energy ratio, and wherein the spectral corrector determining whether an anomaly is present includes:

computing an energy in the frequency band;

computing a ratio of the energy in the frequency band and the energy in a whole band of the sound spectrum; and determining that the anomaly is present when the ratio exceeds a pre-determined value.

4. The method of claim 3, wherein adjusting by the spectral corrector the combined audio signal includes:

adjusting the energy in that band to approximately match a trend in the energy level in the whole band of the sound spectrum.

5. The method of claim 3, wherein the pre-determined value represents or is a ratio value that is pre-determined to indicate anomalies in the sound spectrum.

6. The method of claim 1, wherein the clustering of values of the at least one metric for the combined audio signal in the spectral domain are a clustering of reasonable values for the at least one metric obtained by assessing normal sounding speech and normal sounding music and plotting the at least one metric.

7. The method of claim 6, wherein adjusting by the spectral corrector the combined audio signal includes:

adjusting the value of the at least one metric to correspond to the reasonable values for the at least one metric.

8. The method of claim 7, wherein the reasonable values are static values or the reasonable values are dynamic values, wherein dynamic reasonable values are dependent on values of the metrics in the sound spectrum.

9. The method of claim 1, wherein analyzing portions of the combined audio signal includes determining whether the anomaly is present in the frequency band of the combined audio signal in the spectral domain by using at least two metrics of the plurality of metrics, wherein the at least two metrics include a band energy ratio and a spectral centroid, and wherein adjusting by the spectral corrector the combined audio signal includes adjusting values of the at least two metrics to correspond to the clustering of values of the at least two metrics when the band energy ratio and the spectral centroid are determined to respectively include anomalies.

10. A system of improving an audio signal in the spectral domain comprising:

a combiner to combine a pre-processed speech signal and a pre-processed music signal and generate an audio signal that is a combined audio signal that includes both pre-processed speech and pre-processed music signals;

a sound processor to receive and process the audio signal to tune the audio signal for a sound output device;

a spectral corrector to receive the audio signal from the sound processor, analyze portions of the audio signal in a spectral domain to determine whether an anomaly is present in a frequency band of the audio signal in the spectral domain by using at least one metric of a plurality of metrics, wherein the spectral corrector analyzing portions of the audio signal includes:

detecting a type of content using the at least one metric, wherein the at least one metric includes a spectral tilt and a spectral flux, determining whether to adjust the audio signal based on the type of content detected, and adjust the audio signal to improve the audio signal in the spectral domain when the audio signal is determined to require adjustment, wherein to adjust the audio signal includes to adjust a value of the at least one metric in the frequency band that is determined to include the anomaly to correspond to a clustering of values of the at least one metric for the audio signal in a spectral domain, wherein adjusting the combined audio signal includes applying a first release time on suppression of the combined audio signal when the type of content is a music content, and applying a second release time on suppression of the combined audio signal when the type of content detected is a speech content, wherein the first release time is slower than the second release time.

11. The system of claim 10, further comprising:

the sound output device being at least one of an electronic device's internal speaker, high quality loudspeakers that are external to the electronic device or a headset that is used in connection with the electronic device.

12. The system of claim 10, further comprising:

a speech pre-processor to receive a speech signal from a speech source and to generate the pre-processed speech signal by pre-processing the speech signal to correct defects specific to speech signals; and a music pre-processor to receive a music signal from a music source and to generate the pre-processed music signal by pre-processing the music signal to correct defects specific to music signals.

13. The system of claim 10, wherein the plurality of metrics include a band energy ratio, spectral centroid, spectral variance, absolute thresholds, and relative thresholds.

14. The system of claim 10, wherein the at least one metric further comprises a band energy ratio, and wherein the spectral corrector determines whether an anomaly is present by:

computing an energy in the frequency band;

computing a ratio of the energy in the frequency band and the energy in a whole band of the sound spectrum; and determining that the anomaly is present when the ratio exceeds a pre-determined value.

15. The system of claim 14, wherein adjusting by the spectral corrector the audio signal includes:

adjusting the energy in that band to approximately match a trend in the energy level in the whole band of the sound spectrum.

16. The system of claim 10, wherein the clustering of values of the at least one metric for the audio signal in the spectral domain are a clustering of reasonable values for the at least one metric obtained by assessing normal sounding speech and normal sounding music and plotting the at least one of the metrics.

17. The system of claim 10, wherein the spectral corrector analyzing portions of the audio signal includes determining whether the anomaly is present in the frequency band of the audio signal in the spectral domain by using at least two metrics of the plurality of metrics, wherein the at least two metrics include a band energy ratio and a spectral centroid, and wherein the spectral corrector adjusting the audio signal includes adjusting values of the the at least two metrics to correspond to the clustering of values of the at least two metrics when the band energy ratio and the spectral centroid are determined to respectively include anomalies.

18. A non-transitory computer-readable storage medium having stored thereon instructions, which when executed by a processor, causes the processor to perform a method of improving an audio signal in the spectral domain, the method comprising:

receiving a combined audio signal that includes a pre-processed speech signal and a pre-processed music signal, wherein the combined audio signal is tuned for output by a sound output device;

analyzing portions of the combined audio signal in a spectral domain to determine whether the combined audio signal requires adjustment, wherein analyzing portions of the combined audio signal includes:

determining whether an anomaly is present in a frequency band of the combined audio signal in the spectral domain by using at least one metric of a plurality of metrics, detecting a type of content using the at least one metric, wherein the at least one metric includes a spectral tilt and a spectral flux, determining whether to adjust the combined audio signal based on the type of content detected; and adjusting the combined audio signal to improve the combined audio signal in the spectral domain when the combined audio signal is determined to require adjustment, wherein adjusting the combined audio signal includes adjusting a value of the at least one metric in the frequency band that is determined to include the anomaly to correspond to a clustering of values of the at least one metric for the combined audio signal in a spectral domain, wherein the clustering of values of the at least one metric for the combined audio signal in the spectral domain is a clustering of reasonable values for the at least one metric obtained by assessing normal sounding speech and normal sounding music and plotting the at least one metric wherein adjusting the combined audio signal includes applying a first release time on suppression of the combined audio signal when the type of content is a music content, and applying a second release time on suppression of the combined audio signal when the type of content detected is a speech content, wherein the first release time is slower than the second release time.

* * * * *